United States Patent [19]

Rozenshtein

[11] Patent Number: 4,808,438

[45] Date of Patent: Feb. 28, 1989

[54] APPARATUS AND METHOD FOR PRINTING A MARBLE MOTIF

[76] Inventor: Vladimir Rozenshtein, 159 Beach 123rd St., Rockaway Park, N.Y. 11694

[21] Appl. No.: 150,930

[22] Filed: Feb. 1, 1988

[51] Int. Cl.[4] ..... B05D 5/06; B05D 1/28; B05C 17/02

[52] U.S. Cl. ..... 427/260; 401/47; 401/197; 427/263; 427/281

[58] Field of Search ..... 401/47, 197; 427/263, 427/268, 281, 260; 118/211, 412

[56] References Cited

U.S. PATENT DOCUMENTS

| | | | |
|---|---|---|---|
| 798,888 | 9/1905 | Du Brau | 401/47 |
| 1,931,667 | 10/1933 | Loetscher | 427/268 |
| 2,118,719 | 5/1938 | Wraal | 101/171 |
| 2,548,580 | 4/1951 | Bick | 101/331 |
| 2,753,641 | 7/1956 | Dorman | 101/328 |
| 2,833,073 | 5/1958 | Doggett | 101/331 |
| 3,084,069 | 4/1963 | Simon | 427/429 |
| 3,089,180 | 5/1963 | Humphrey | 401/9 |
| 3,134,327 | 5/1964 | Sebanc | 101/331 |
| 3,341,396 | 9/1967 | Iverson | 428/142 |
| 4,217,062 | 8/1980 | TRP et al. | 401/44 |

*Primary Examiner*—Evan Lawrence

*Attorney, Agent, or Firm*—Amster, Rothstein & Ebenstein

[57] ABSTRACT

An apparatus and method for printing a marble motif. The apparatus comprises a holder, including a hand gripping portion, a hollow cylindrical roller rotatably mounted in the holder defining a first set of perforations, and a partition disposed within the roller to divide the hollow of the roller into a plurality of compartments adapted to receive different colored paints. The partition defines a second set of perforations to permit limited fluid communication between the compartments to partially mix the paints. A porous absorbent material is positioned over the roller and in fluid communication with the first set of perforations. The method comprises separately storing a plurality of different colored paints in the compartments, and rolling the porous absorbent material over a surface to cause the partially mixed paints to print a marble motif on the surface.

11 Claims, 3 Drawing Sheets

APPARATUS AND METHOD FOR PRINTING A MARBLE MOTIF

BACKGROUND OF THE INVENTION

The present invention relates to decorating implements, and more particularly to a method and apparatus for creating marble motifs on a given surface.

The imitation of marble, granite, and other stones has recently been gaining much attention and interest from the public. However, this form of decorating is very complicated and requires the use of manual or hand painted work and the use of such implements as newspapers, sponges, rags, resins, polyethylene bags, paper towels, etc.. These miscellaneous materials are very difficult to work with, leave a tremendous mess, and require a great deal of skill and training in the art of decorating.

For example, U.S. Pat. No. 3,341,396 discloses a complicated method of "marbleizing" that involves manually applying different colored pigments in a random discontinuous pattern over a base layer of a curable synthetic resinous liquid. A marbleized motif is created by manually dragging tools over the surface to mix or diffuse the colored pigments.

U.S. Pat. No. 1,931,667 discloses a complicated method for marbleizing a thin paper surface for subsequent affixation to a base material such as wood panels, plasterboard, pulp, fibrous panel boards or the like. The method involves the distribution of minute quantities of an oil color on a water bath to create vein like or mottled patterns similar to the markings found in natural marble. This pattern is transferred to the paper and then fixed to the base material.

Even though this form of decorating has existed for ages, no successful tool has yet been devised to enable simple and time efficient printing of marble-like patterns on a given surface. To the contrary, in order to create a marble motif in a mid-sized room by conventional methods, a professional must put in approximately 7–10 hours of demanding work.

Accordingly, it is an object of the present invention to provide apparatus which allows for simple and time efficient printing of marble like patterns on a given surface.

Another object is to provide such apparatus which provides a fine design comparable to the standards of hand painted work.

A further object is to provide such apparatus to create a marble vein motif.

It is also an object to provide such apparatus which is lightweight, easy to use and easy to maintain.

It is another object to provide such apparatus which is of simple and economical construction, and inexpensive to manufacture and use.

It is a further object to provide a method for using such apparatus.

SUMMARY OF THE INVENTION

It has now been found that the above and related objects of the present invention are attained in an apparatus for printing a marble motif on a given surface. The apparatus comprises a holding means, including a hand gripping portion, a hollow cylindrical roller rotatably mounted in the holding means for rotation about a longitudinal axis defining a first set of perforations, and a partitioning means disposed within the roller. The partitioning means divides the hollow of the roller into a plurality of compartments adapted to receive different colored paints, and defines a second set of perforations to permit limited fluid communication between the compartments. A porous absorbent material is positioned over the roller and is in fluid communication with the first set of perforations. The different colored paints stored in the compartments slowly seep through the second set of perforations to partially mix the paints, and the partially mixed paints slowly seep through the first set of perforations to moisten the porous absorbent material.

Preferably, the partitioning means extends longitudinally throughout the length of the roller to divide the hollow of the roller into a plurality of longitudinally extending compartments. It is also preferable that the first and the second set of perforations enable the different colored paints to simultaneously seep therethrough during rotation of the roller about its longitudinal axis to simultaneously partially mix the paints and moisten the porous absorbent material.

In a preferred embodiment, the roller enables the porous absorbent material to roll over a surface to cause the partially mixed paints to print a marble motif on the surface.

The holding means includes means for rotatably mounting the roller and the partitioning means in coaxial disposition for rotation together as a unit. More particularly, the mounting means includes means for sealing the ends of the compartments dividing the hollow of said roller, and the sealing means includes fluid-tight retaining means engaging each end of the roller, each end of the partition means, and the hand gripping portion.

A method for printing a marble motif on a given surface comprises the steps of separately loading different colored paints in compartments adapted to receive the different colored paints, and partially mixing the different colored paints in the compartments while simultaneously applying the partially mixed paints to a surface to print a marble motif.

Preferably, the method for printing a marble motif comprises the additional steps of providing a roller having a substantially continuous and irregular projection circumferentially disposed thereto, transferring paint on the irregular projection, and rotating the roller over the marble motif to cause the paint disposed on the irregular projection to print veins on the marble motif to create a marble vein motif.

A preferred embodiment for the method of printing a marble motif comprises the first step of providing a marbleizer comprising a holding means including a hand gripping portion, a hollow cylindrical roller defining a first set of perforations rotatably mounted in the holding means for rotation about a longitudinal axis, and a partitioning means defining a second set of perforations. The partitioning means is disposed within the roller to divide the hollow of the roller into a plurality of longitudinally extending compartments adapted to receive different colored paints, and defines a second set of perforations to permit limited fluid communication between the compartments to allow each different colored paint to slowly seep through the second set of perforations to partially mix the paints. A porous absorbent material is positioned over the roller and is in fluid communication with the first set of perforations to permit the passage of the partially mixed paints into the porous absorbent material. Next, a different colored paint is loaded into each of the compartments, and then the porous absorbent material is rolled over a surface to rotate the roller about its longitudinal axis to cause the partially mixed paints to print a marble motif on the surface.

Preferably the method for printing a marble vein motif further comprises the first step of providing a vein roller comprising a holding means including a hand gripping portion, and a first rolling means and a second rolling means both rotatably mounted in the holding means for rotation about a longitudinal axis. The first rolling means has a substantially continuous and irregular projection circumferentially disposed thereto, and the second rolling means is fixed proximate to the first rolling means. A porous absorbent material is positioned over the second rolling means for storing and releasing paint and makes continuous contact with the irregular projection to transfer the stored paint onto the irregular projection. The vein roller is then rolled over the marble motif to rotate the first rolling means about its longitudinal axis. This causes the paint disposed on the irregular projection to print veins on the marble motif to create a marble vein motif.

BRIEF DESCRIPTION OF THE DRAWING

The above brief description, as well as further objects and features of the present invention, will be more fully understood by reference to the following detailed description of the presently preferred, albeit illustrative, embodiments of the present invention when take in conjunction with the accompanying drawing wherein similar reference numerals denote similar elements throughout the several figures.

DETAILED DESCRIPTION OF THE PREFERRED EMBODIMENT

Figures 1, 2:
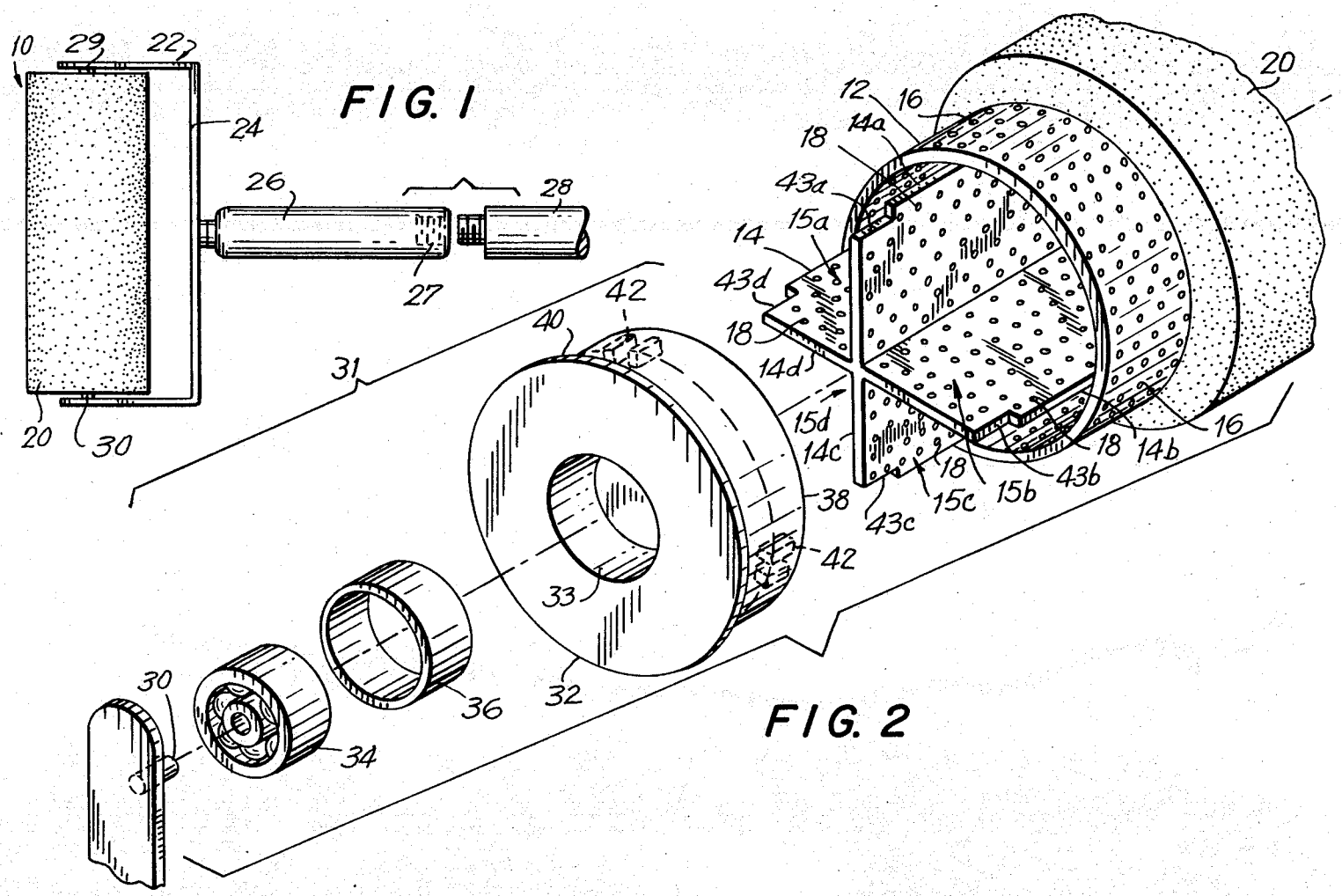
FIG. 1 is a top plan view of a marbleizer according to the present invention.
FIG. 2 is a fragmentary exploded isometric view of the marbleizer.
Figure 3:
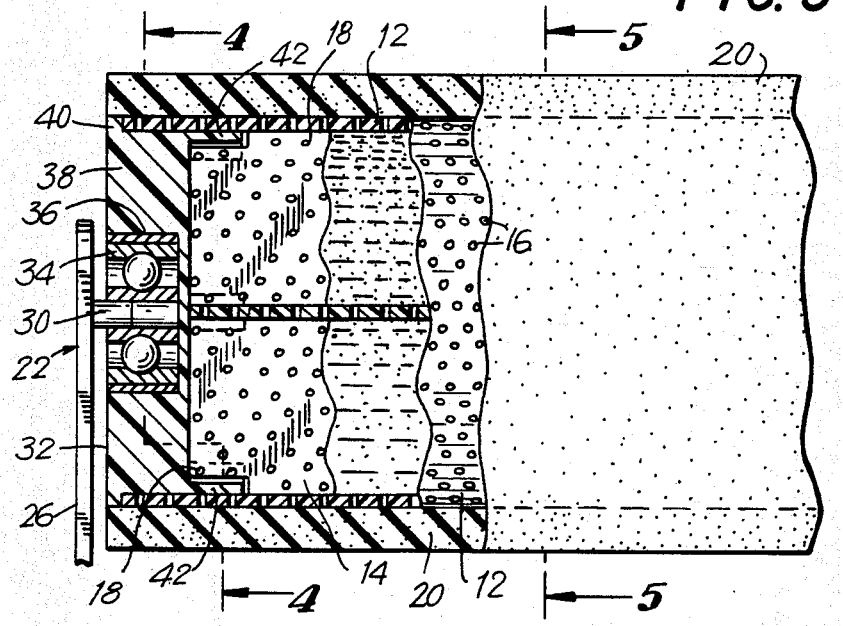
FIG. 3 is a fragmentary sectional view of the marbleizer with portions removed to reveal details of internal construction.
Figure 4:
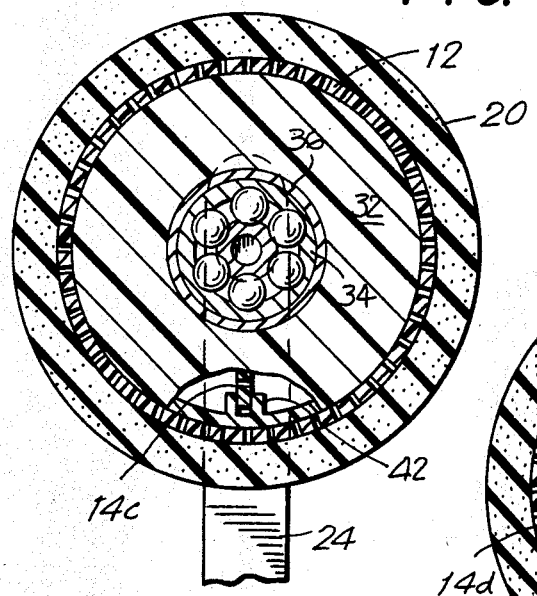
FIG. 4 is a fragmentary sectional view of the marbleizer taken along line 4—4 of FIG. 3.
Figure 5:
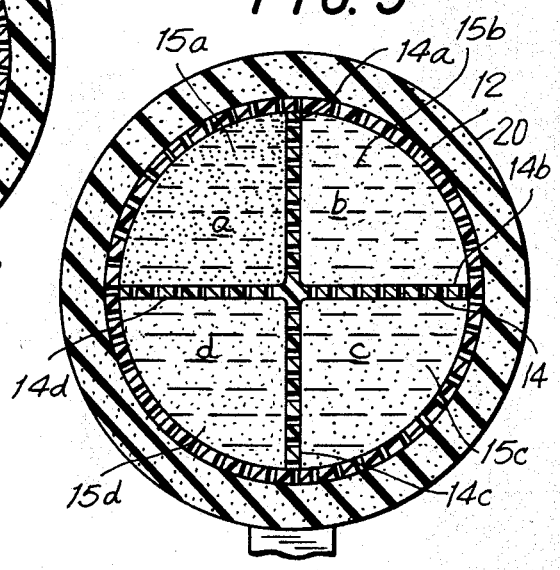
FIG. 5 is a fragmentary sectional view of the marbleizer taken along line 5—5 of FIG. 3.

Referring now to the drawing and in particular to FIGS. 1–2 thereof, therein illustrated is an embodiment of the present invention comprising a marbleizer, generally designated by the reference numeral 10. The marbleizer 10 comprises a hollow cylindrical roller 12 and a partitioning means 14 disposed within the roller 12. The partitioning means 14 defines four fins, 14*a*, 14*b*, 14*c*, 14*d* radially extending from a central core to an inner wall of the roller 12. The partitioning means divides the hollow of the roller 12 into four longitudinally extending compartments 15*a*, 15*b*, 15*c* and 15*d* of generally equal size extending throughout the length of the roller 12, each of the compartments being adapted to receive a different colored paint. It will be appreciated that the partitioning means 14 can consist of any number of fins to divide the hollow of the roller 12 into any number of compartments, and that the compartments can take on a variety of shapes.

The roller 12 defines a first se of perforations 16, and the partitioning means 14 defines a second set of perforations 18. A porous absorbent material 20 is positioned over the roller 12 and is in fluid communication with the first set of perforations 16. The porous absorbent material 20 can be rubber, sponge, felt, or any other material that is capable of storing and releasing paints, colored pigments or any other type of fluid associated with painting apparatus.

The roller 12 and the partitioning means 14 are rotatably mounted in coaxial disposition for rotation together as a unit on holding means, generally designated 22. The holding means 22 includes a hand gripping portion 24 having a handle portion 26. The handle portion 26 is provided with a threaded portion 27 to make the handle portion 26 compatible with an extension pole 28. The hand gripping portion 24 includes a pair of protrusions, 29 and 30, fixed normal thereto.

The holding means 22 further includes mounting means, generally designated 31. The mounting means 31 includes a first retaining cup 32 having a recess 33, a centrally apertured first ball bearing means 34, and a first gasket 36 to engage one end of the roller 12 and the partitioning means 14. A second retaining cup, a second centrally apertured ball bearing means and a second gasket engage an opposite end of the roller 12 and the partitioning means 14, not shown.

Referring now to FIGS. 2–5, the marbleizer 10 is operated by first removing the retaining cup 32 from one end of the roller 12 and the partitioning means 14, and then loading up to four different colored paints a, b, c and d, into each of the four longitudinally extending compartments 14*a*, 14*b*, 14*c*, 14*d*. The paints are to be selected according to the colors of the individual shades of marble or granite to ultimately combine into a realistic marble or granite motif. Once the compartments are filled with paint, the compartments are then sealed by engaging the partitioning means 14 and the roller 12 with the previously removed retaining cup 32, for rotation of the retaining cups, the roller 12 and the partitioning means 14 together as a unit.

Although it is not necessary to separately fill each compartment with a different colored paint, it is recommended to do so to provide a maximum marbleizing effect. However, by varying the number of compartments and the number of different colored paints loaded into the compartments, a variety of different effects can be created.

To engage the roller 12 with the retaining cup 32, an inner portion 38 of the retaining cup 32 is received within the roller 12, and a lip portion 40 of the retaining cup 32 enters in a flush and abutting relationship with the end of the roller 12. To engage the partitioning means 14 with the retaining cup 32, the fins 14*a*, 14*b*, 14*c*, 14*d* of the partitioning means 14 are received by an equal number of partitioning support means 42 located within the inner portion 38 of the retaining cup 32. The support means 42 define guideways adapted to receive trimmed back portions 43*a*, 43*b*, 43*c*, 43*d* of the fins 14*a*, 14*b*, 14*c* and 14*d*. It will be appreciated by those skilled in the art that the retaining cups must be fluid tight to prevent against any loss of paint once the partitioning means 14 and the roller 12 are sealed by the retaining cups.

To rotatably mount the roller 12 and the partitioning means 14 on the holding means 22, the centrally apertured ball bearing means 34 is mounted in a gasket 36, which in turn is mounted within the recess 33 of the retaining cup 32. The entire assembly is then mounted on the protrusions 29 and 30 of the hand gripping portion 24 which allows for free rotation of the roller 12 and the partitioning means 14 in coaxial disposition together as a unit about their longitudinal axes, i.e., the protrusions 29 and 30.

Referring now to FIGS. 1–5 and 8, to print a marble motif on a given surface, a user of the marbleizer 10, gripping the handle portion 26, now rolls the porous absorbent material 20 over a surface 44 to rotate the roller 12 about its longitudinal axis. During such rotation, the paints a, b, c and d partially mix by slowly seeping through the second set of perforations 18 of the partitioning means 14. Due to the size of the perforations 18 and to the viscosity of the paints, the paints are not allowed to completely mix into a single solid color. This enables the user of the marbleizer 10 to continue working for a prolonged period of time without the need to clean or refill the compartments **14*a*, 14*b*, 14*c* and 14*d*** with fresh paint.

Simultaneously with the partial mixing of the paints, a, b, c and d, the partially mixed paints slowly seep through the first set of perforations 16 of the roller 12 to moisten the porous absorbent material 20. Thus, when the porous absorbent material 20 is rolled over the surface 44, a design 46 is printed on the surface 44 consisting of a combination of different shades of color resulting from the partially mixed paints. This represents a marble motif. If the roller leaves behind unwanted residue such as a heavy blot of paint, it is recommended that the user should run over the design with a brush in a soft single directional motion while the paint is still wet.

It will be readily appreciated by those skilled in the art that upon introduction of the different colored paints a, b, c and d into the compartments **15*a*, 15*b*, 15*c*, and 15*d*, the paints will instantaneously begin to partially mix and moisten the porous absorbent material 20. Rotation of the roller 12 aids in the partial mixing of the paints and provides uniform moistening of the porous absorbent material 20. The flow rate of the paint or other colored pigments flowing through the first and second set of perforations, 16 and 18**, can be adjusted by varying the viscosity of the paint, the size of the perforations, the frequency or density of the perforations or by any of the known methods.

Figure 7:
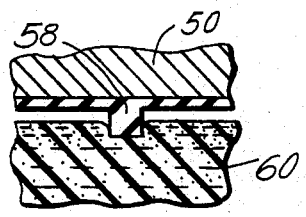
FIG. 7 is a fragmentary sectional view of the vein roller taken along line 7—7 of FIG. 6.
Figure 6:
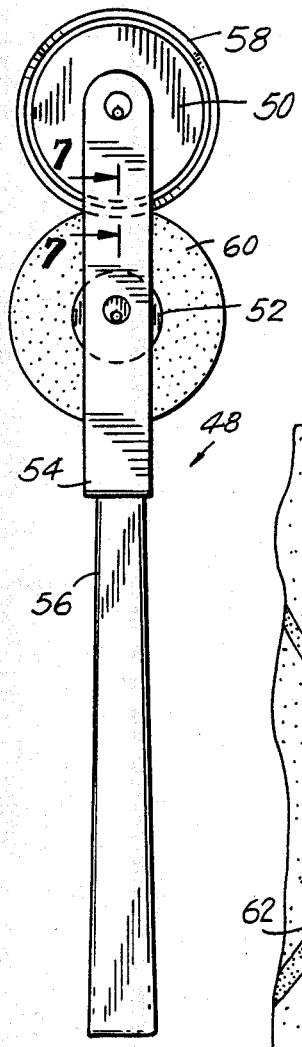
FIG. 6 is a side elevation view of a spider vein roller according to the present invention.
Figure 8:
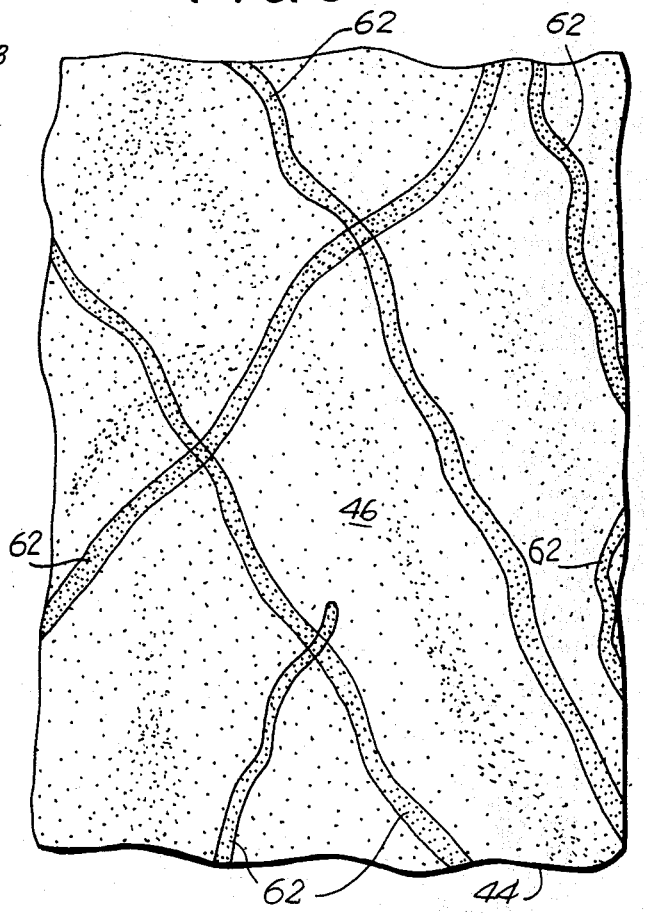
FIG. 8 is a front-elevation view of a surface having printed thereon a marble vein motif.

Referring now to FIGS. 6–8, a spider vein roller, generally designated 48, can be used to print veins on the design 46 to create a marble vein motif. The vein roller 48 comprises a first rolling means 50 and a second rolling means 52 both fixed proximate to each other and rotatably mounted in a hand gripping portion 54 for rotation of both rolling means 50 and 52 about their longitudinal axes. The hand gripping portion 54 includes a handle portion 56.

The first rolling means 50 includes a substantially continuous and irregular projection 58 circumferentially disposed thereto, and the second rolling means 52 includes an absorbent material 60 positioned over the rolling means 52 for storing and releasing paint. With reference to FIG. 7, the porous absorbent material 60 is configured and dimensioned to make continuous contact with the irregular projection 58 to transfer stored paint onto the irregular poojection 58.

To create the marble vein motif, the vein roller 48 is repeatedly rolled over the marble motif 46 to rotate the first rolling means 50 about its longitudinal axis which causes the second rolling means 52 to rotate about its longitudinal axis. This causes the paint stored in the porous absorbent material 60 to transfer onto the irregular projection 58 which will print veins 62 on the marble motif 46 when the irregular projection 58 contacts the marble motif 46. Thus the combination of the marble motif 46 and the veins 62 result in a marble vein motif.

To summarize, the marbleizer of the present invention allows an average person to create a superior marble motif by putting into a mid sized room, a mere 1–2 hours of moderately demanding work. Using the marbleizer provides a fine design comparable to the standards of hand painted work. The marbleizer is lightweight, easy to use and easy to maintain. It is of simple and economical construction, and is inexpensive to manufacture and use. A spider vein roller can be used to create a marble vein motif.

Now that the preferred embodiments have been shown and described in detail, various modifications and improvements thereon will become readily apparent to those skilled in the art. Accordingly, the appended claims are to be construed broadly and in a manner consistent with the spirit and scope of the present invention.

What is claimed is:

1. A marbleizer comprising:

holding means, including a hand gripping portion;

a hollow cylindrical roller rotatably mounted in said holding means for rotation about a longitudinal axis and defining a first set of perforations;

partitioning means disposed within said roller to divide the hollow of said roller into a plurality of compartments adapted to receive different colored paints, said partitioning means defining a second set of perforations permitting limited fluid communication between said compartments; and a porous absorbent material positioned over said roller and in fluid communication with said first set of perforations;

whereby the different colored paints stored in said compartments slowly seep through said second set of perforations to partially mix the paints, and the partially mixed paints slowly seep through said first set of perforations to moisten said porous absorbent material.

2. The marbleizer of claim 1 wherein said partitioning means extends longitudinally throughout the length of said roller to divide the hollow of said roller into a plurality of longitudinally extending compartments.

3. The marbleizer of claim 1 wherein said roller enables said porous absorbent material to roll over a surface to cause the partially mixed paints to print a marble motif on the surface.

4. The marbleizer of claim 1 wherein said first and said second set of perforations enable the different colored paints to simultaneously seep therethrough during rotation of said roller about its longitudinal axis to simultaneously partially mix the paints and moisten said porous absorbent material.

5. The marbleizer of claim 1 wherein said holding means includes means for rotatably mounting said roller and said partitioning means in coaxial disposition for rotation together as a unit.

6. The marbleizer of claim 5 wherein said mounting means includes means for sealing the ends of said compartments dividing the hollow of said roller.

7. The marbleizer of claim 6 wherein said sealing means includes fluid tight retaining means engaging each end of said roller, each end of said partitioning means, and said hand gripping portion.

8. A method for printing a marble motif comprising the steps of:

providing a multicolor marbleizer comprising a holding means including a hand gripping portion; a hollow cylindrical roller defining a first set of perforations rotatably mounted in said holding means for rotation about a longitudinal axis; a partitioning means defining a second set of perforations disposed within said roller to divide the hollow of said roller into a plurality of longitudinally extending compartments adapted to receive different colored paints, said partitioning means defining a second set of perforations permitting limited fluid communication between said compartments to allow each different colored paint to slowly seep through said second set of perforations to partially mix the paints; and, a porous absorbent material positioned over said roller and in fluid communication with said first set of perforations to permit the passage of said partially mixed paints into said porous absorbent material;

loading different colored paints into said compartments; and rolling said porous absorbent material over a surface to rotate said roller about its longitudinal axis and thereby cause the partially mixed paints to print a marble motif on the surface.

9. The method of claim 8 further comprising the additional steps of:

providing a vein roller comprising a holding means including a hand griping portion and first rolling means and second rolling means rotatably mounted in said holding means for rotation about a longitudinal axis, said first rolling means having a substantially continuous and irregular projection circumferentially disposed thereon, said second rolling means being fixed proximate to said first rolling means; and an absorbent material positioned over said second rolling means for storing and releasing paint, said absorbent material making continuous contact with said irregular projection to transfer the stored paint onto said irregular projection; and rolling the vein roller over the marble motif to rotate the first rolling means about its longitudinal axis to cause the paint stored in the absorbent material to transfer onto the irregular projection to print veins on the marble motif, thereby creating a marble vein motif.

10. A method for printing a marble motif comprising the steps of:

separately loading different colored paints in compartments adapted to receive the different colored paints; and partially mixing the different colored paints in the compartments while simultaneously applying the partially mixed paints to a surface to print a marble motif.

11. The method of claim 10 further comprising the additional steps of:

providing a roller having a substantially continuous and irregular projection circumferentially disposed thereon;

transferring paint onto the irregular projection; and rotating the roller over the marble motif to cause the paint disposed on the irregular projection to print veins on the marble motif, thereby creating a marble vein motif.

* * * * *